US008512561B2

(12) United States Patent
Al-Anzi

(10) Patent No.: US 8,512,561 B2
(45) Date of Patent: Aug. 20, 2013

(54) WATER AERATOR USING A COMPRESSED GAS CONTAINER

(76) Inventor: Bader Shafaqa Al-Anzi, Safat (KW)

( * ) Notice: Subject to any disclaimer, the term of this patent is extended or adjusted under 35 U.S.C. 154(b) by 73 days.

(21) Appl. No.: 13/586,323

(22) Filed: Aug. 15, 2012

(65) Prior Publication Data

US 2013/0187297 A1 Jul. 25, 2013

Related U.S. Application Data

(63) Continuation of application No. 13/354,170, filed on Jan. 19, 2012.

(51) Int. Cl.
*E02B 15/04* (2006.01)
*B01F 3/04* (2006.01)

(52) U.S. Cl.
USPC ..... 210/242.2; 210/220; 210/121; 210/122; 210/242.1; 261/120; 261/122.1; 366/101

(58) Field of Classification Search
USPC ..... 210/121–122, 220, 242.2, 242.1; 261/120, 122.1; 366/101
See application file for complete search history.

(56) References Cited

U.S. PATENT DOCUMENTS

| | | | | | |
|---|---|---|---|---|---|
| 2,744,065 | A * | 5/1956 | Lacey | 261/36.1 |
| 3,193,260 | A * | 7/1965 | Lamb | 261/64.1 |
| 3,628,775 | A * | 12/1971 | McConnell et al. | 261/37 |
| 3,664,647 | A * | 5/1972 | Snow | 261/30 |
| 3,802,673 | A * | 4/1974 | Ross | 261/91 |
| 3,820,272 | A * | 6/1974 | Calamas | 43/57 |
| 3,936,381 | A * | 2/1976 | Pacaud | 210/195.1 |
| 4,079,008 | A * | 3/1978 | Neumann | 210/194 |
| 4,268,398 | A * | 5/1981 | Shuck et al. | 111/101 |
| 4,350,589 | A * | 9/1982 | Stog | 210/220 |
| 4,485,013 | A * | 11/1984 | Cockman | 210/242.2 |
| 4,906,359 | A * | 3/1990 | Cox, Jr. | 210/170.02 |
| 4,911,838 | A * | 3/1990 | Tanaka | 210/221.2 |
| 5,326,475 | A * | 7/1994 | Kent | 210/615 |
| 5,859,589 | A * | 1/1999 | McGrew, Jr. | 340/614 |
| 6,106,704 | A * | 8/2000 | Drewery | 210/86 |
| 6,264,176 | B1 * | 7/2001 | Dickman et al. | 261/77 |
| 6,284,135 | B1 * | 9/2001 | Ookata | 210/220 |
| 6,390,456 | B1 * | 5/2002 | Lee et al. | 261/120 |
| 7,121,536 | B2 * | 10/2006 | Ruzicka et al. | 261/91 |
| 7,267,325 | B2 * | 9/2007 | Tsai | 261/34.1 |
| 7,329,351 | B2 * | 2/2008 | Roberts et al. | 210/620 |
| 7,954,791 | B2 * | 6/2011 | Mitchell et al. | 261/120 |
| 2005/0161409 | A1 * | 7/2005 | O'Hara | 210/758 |

(Continued)

OTHER PUBLICATIONS

Derwent abstract for KR2001091607A.*

*Primary Examiner* — David C Mellon
(74) *Attorney, Agent, or Firm* — Richard C. Litman

(57) ABSTRACT

The water aerator using a compressed gas container is a self-contained unit having a float and a container of compressed gas (e.g., air, oxygen, etc.) installed beneath a perforated diffuser plate that, in turn, is positioned below the float. High-pressure gas from the container flows through a pipe or tube to a regulator valve and pressure gauge at the top of the pipe. A larger diameter low-pressure pipe or tube is placed concentrically about the high-pressure pipe. Regulated low-pressure gas flows down through the outer low-pressure pipe to a dispensing nozzle below the diffuser plate, whereupon the gas flows upward and is broken up by the perforations in the diffuser plate to form smaller aeration bubbles. An electrical power source, pressure switch, and light may be provided to indicate when the compressed gas container is depleted. The device may be motorized.

12 Claims, 3 Drawing Sheets

(56) References Cited

U.S. PATENT DOCUMENTS

2005/0253288 A1* 11/2005 Gross et al. ..... 261/28
2006/0065205 A1* 3/2006 Venezia ..... 119/245
2007/0035046 A1* 2/2007 Wensloff ..... 261/93
2009/0230041 A1* 9/2009 Sun et al. ..... 210/170.05

* cited by examiner

WATER AERATOR USING A COMPRESSED GAS CONTAINER

CROSS-REFERENCE TO RELATED APPLICATIONS

This is a continuation of my prior application Ser. No. 13/354,170, filed Jan. 19, 2012 now pending.

BACKGROUND OF THE INVENTION

1. Field of the Invention

The present invention relates generally to water treatment systems, and particularly to a water aerator using a compressed container as the aerating agent.

2. Description of the Related Art

The contamination of various bodies of water by various means is an increasingly serious problem worldwide. Perhaps the most widespread contaminants are organic materials that enter the water system due to pollution from human habitation, either directly or indirectly, e.g., pollution from farms and the like. Such pollution can affect inland fresh water supplies (lakes and rivers), and can also be carried to the sea by inland rivers and waterways or by direct discharge of sewage and/or other pollutants into the sea. Organic material in the sewage of treatment plants is another example of such pollution, albeit contained for processing. The biochemical processes that occur in water due to such organic pollution are known to decrease the oxygen content of the water, thereby reducing or perhaps even destroying fish and other aquatic life in the contaminated body of water. Even if some fish remain in the polluted water, they are almost certainly unfit for human consumption, if caught.

It is generally considered that the most effective means of eliminating such pollutants in contaminated water is by bacteriological processing, wherein bacteria process the contaminants to break them down into harmless organic materials. However, such bacteria are aerobic, i.e., they require oxygen for their metabolism. This is well known in the sewage treatment field, where water is commonly treated by aeration after solids are removed by settling or other means. Such aeration is generally accomplished by mechanical means, e.g., pumping the water up for dispensing into the air from spray booms and nozzles, or by forcing air through underwater pipes for the air to bubble up through the water. Such mechanical systems are relatively costly to operate and require relatively high energy and manpower costs. Even if such systems were less costly to operate, a huge drawback is that they cannot be readily transported to a pollution site for operation at that site. Rather, the water must be transported to the location of the aeration system, a process that is clearly unworkable on a very large scale and/or over very long distances.

A number of different water aeration devices and systems have been developed in the past. An example of such is found in Korean Patent Publication No. 2003-0000988, published on Jan. 6, 2003. This reference describes (according to the drawings and English abstract) various embodiments of a water aeration device using a remotely situated air or gas supply and pump. The diffuser is either placed on the bottom of the body of water, or suspended at some intermediate depth between a float and an anchor weight.

Thus, a water aerator using a compressed gas container solving the aforementioned problems is desired.

SUMMARY OF THE INVENTION

The water aerator using a compressed gas container includes a structure supported by a float, and a perforated diffuser plate supported by the structure beneath the surface of the water. A container of pressurized gas (e.g., air, oxygen, or other gas as desired) is suspended below the diffuser plate. The superstructure extending above the float and the surface of the water includes a regulator valve and pressure gauge extending therefrom, which communicate pneumatically with the container of pressurized gas. Gas flows from the container upward through a tube to the regulator valve, the valve reducing the pressure as required. The lower pressure gas then flows back down through another tube to an outlet nozzle below the diffuser plate. The gas flows from the nozzle up to the diffuser plate to be broken up into myriad small bubbles for efficient aeration.

The above-described apparatus needs no other source of power for its operation, since the only power required is provided by the pressure of the gas escaping from the pressurized container. However, a self-contained electrical power source, e.g., an electrical storage battery, may be provided to supply power to a light, if desired. The light may be selectively actuated by a pressure switch that communicates with the pneumatic pressure of the container, so that the light is actuated when the pressure drops to some predetermined level to indicate that the pressurized container must be replenished or replaced. Alternatively, notification of a depleted gas container may be provided by a wireless signal.

The superstructure of the device may include depth indicators to indicate the buoyancy of the apparatus. While the depletion of the gas from the pressurized gas container would not likely change the buoyancy of the entire device to any great extent, in some cases the buoyancy could change, depending upon the volume of the container and the initial and depleted pressures therein. Such depth or buoyancy indicators also serve to show the integrity of the float, i.e., to alert observers if the float is damaged in some manner. A small propulsion unit may be provided to navigate the structure to a different area. Power is supplied by the on-board battery, and navigation may be by a preprogrammed on-board controller or remotely controlled by an operator.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
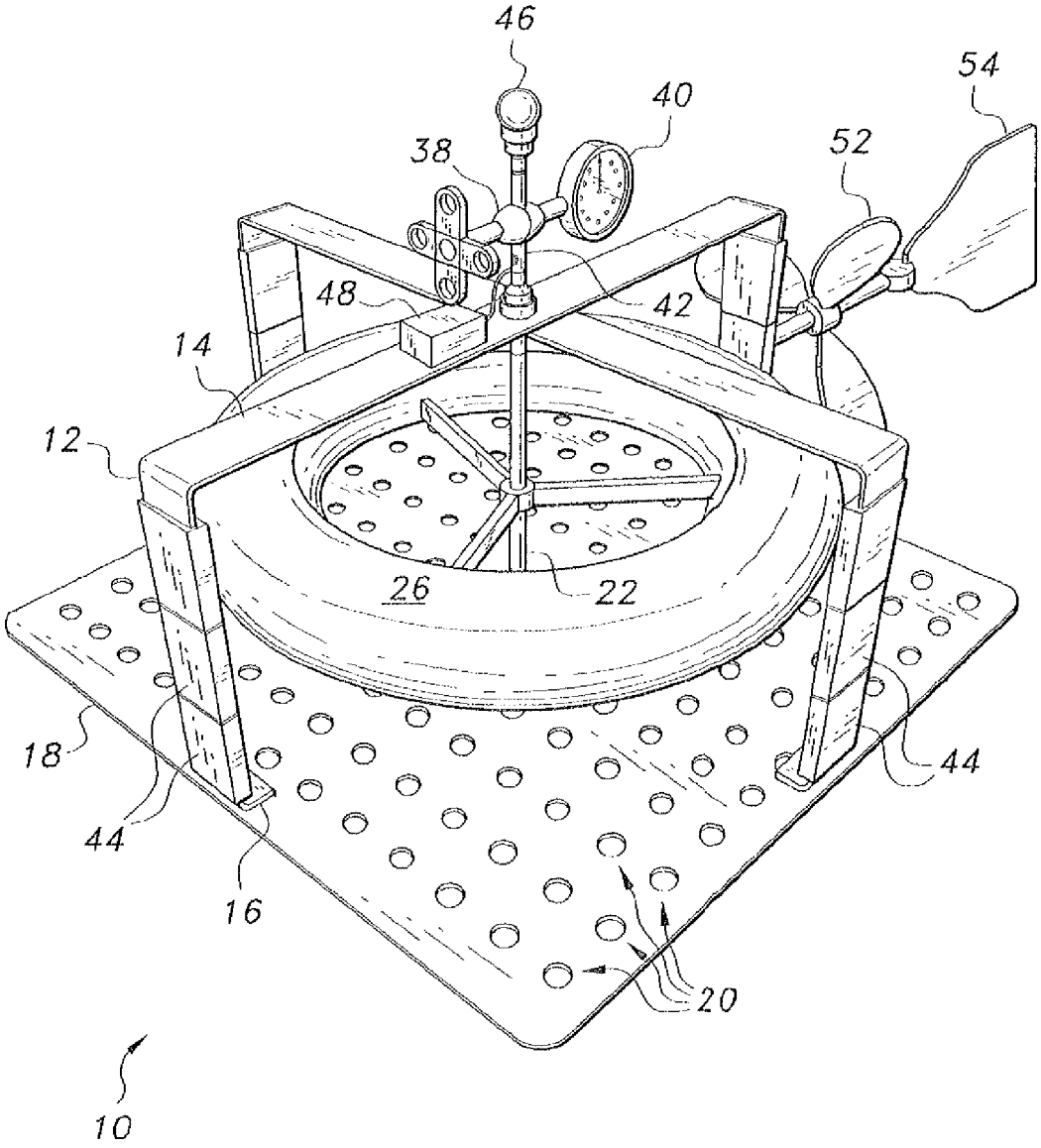
FIG. 1 is a perspective view of a water aerator using a compressed gas container according to the present invention, illustrating its basic structure.
Figure 2:
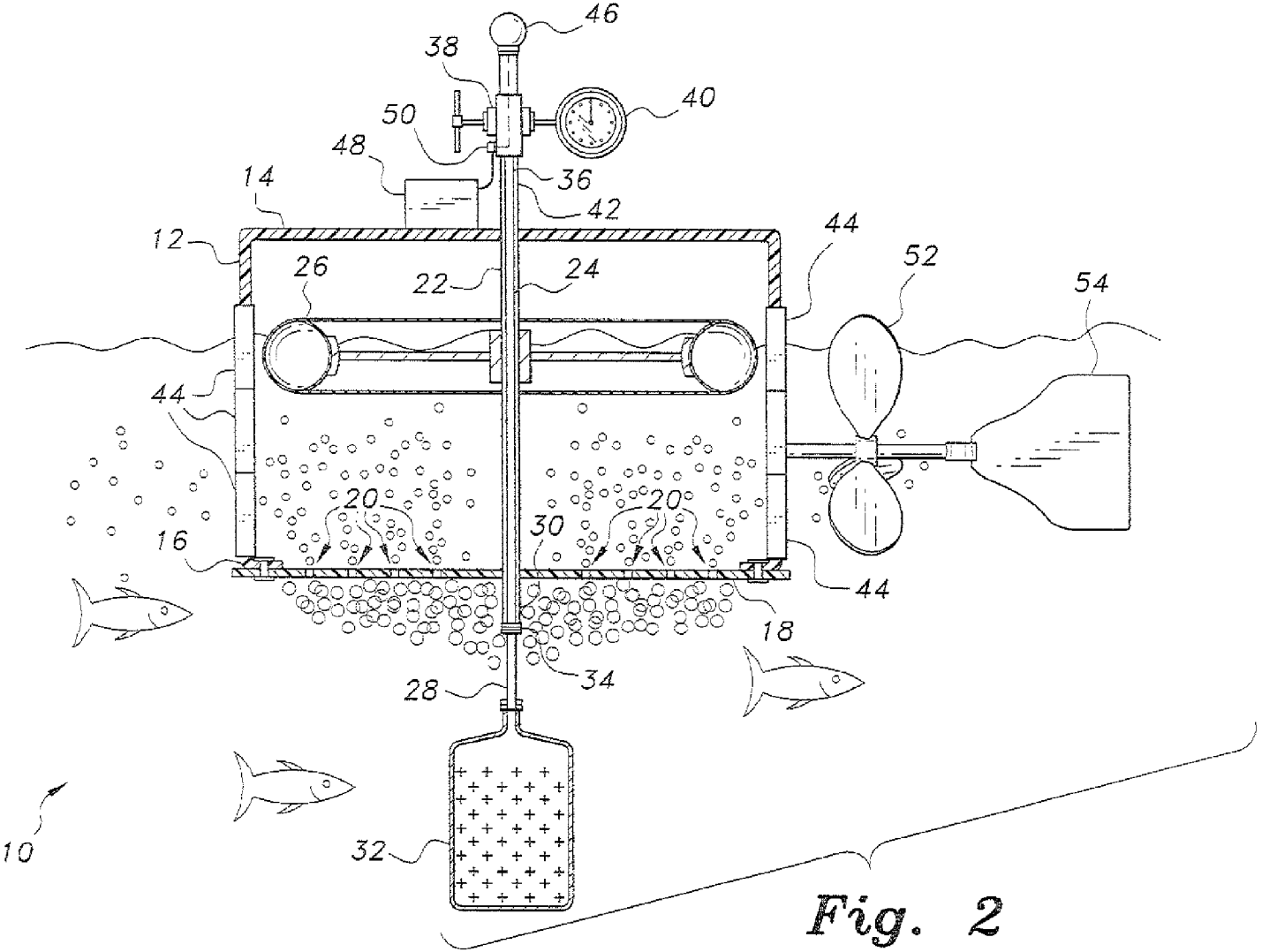
FIG. 2 is a side elevation view in section of the water aerator of FIG. 1, illustrating its internal structure.
Figure 3:
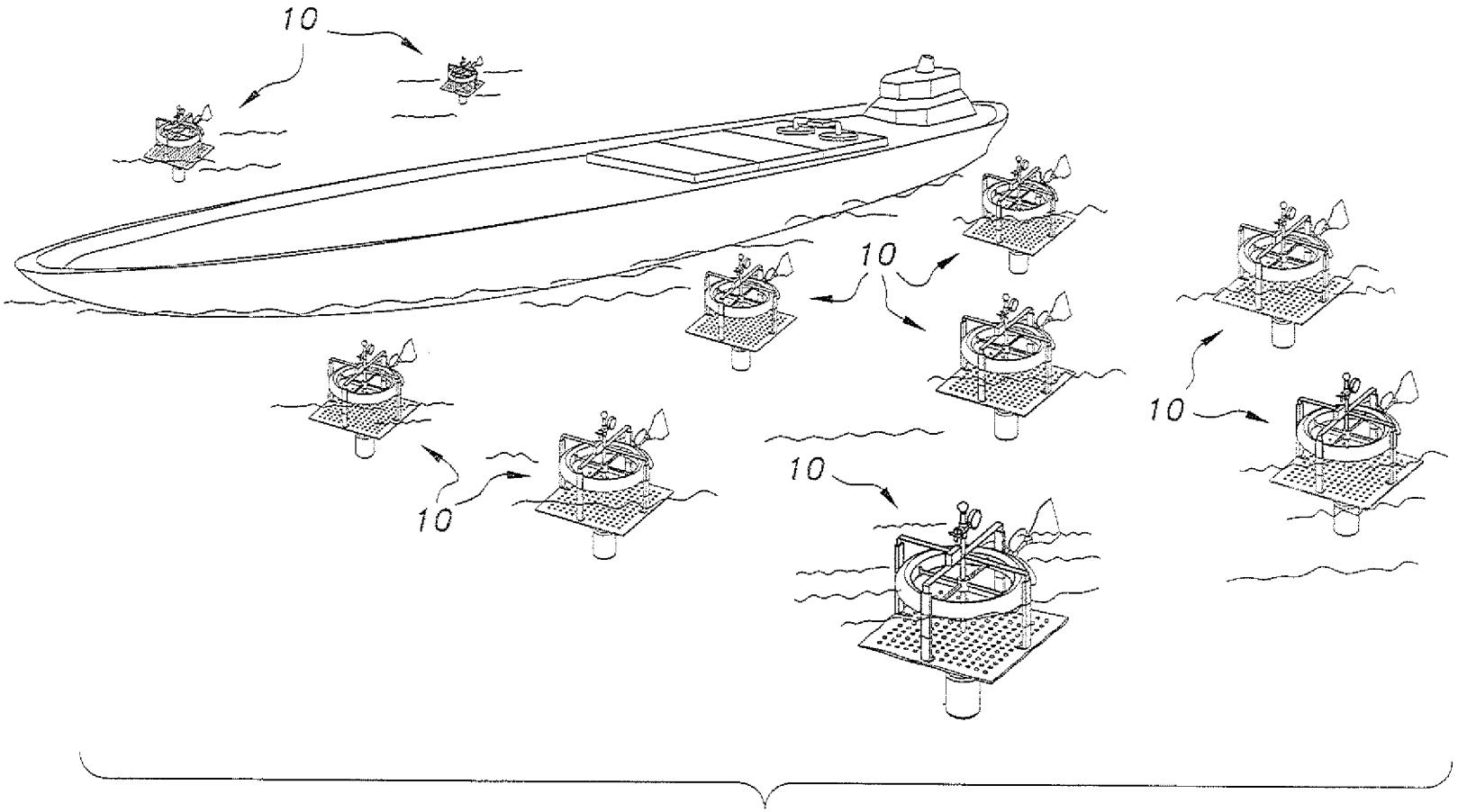
FIG. 3 is an environmental perspective view of a plurality of water aerators using compressed gas containers according to the present invention, illustrating their deployment in a body of water.

The water aerator using a compressed gas container is a self-contained system that may be deployed in virtually any body of water to provide automatic aeration of at least the upper stratum of the water. FIGS. 1 and 2 of the drawings provide views showing details of the aerator 10, while FIG. 3 illustrates the deployment of a plurality of such aerators 10 in a relatively large body of water.

The aerator 10 includes an aerator frame 12 having an upper portion 14 and an opposite lower portion 16. The frame 12 may be a relatively simple and lightweight structure, comprising a pair of mutually orthogonal upper crossmembers having a vertical arm depending from the ends of each of the crossmembers. The lower portions and ends of the arms comprise the lower portion 16 of the frame 12. The frame 12 shown in the drawings is exemplary, and other frame configurations may be used. A diffuser plate 18 is attached to the lower portion 16 of the frame 12, i.e., to the lower extremities of the vertical arms of the frame 12. The plate 18 spans the lateral extent of the frame 12. The diffuser plate 18 includes a large number of relatively small perforations 20 therethrough. The perforations 20 serve to break up the aeration bubbles produced by the aerator to form myriad smaller bubbles for more efficient aeration. While the diffuser plate 18 is shown as a substantially square sheet of material, the plate may be circular or any other shape.

As shown in FIG. 2, a vertical column comprising an outer low pressure gas supply pipe or tube 22 and an inner high pressure gas supply pipe or tube 24 extends through the center of the diffuser plate 18 and through the center of the upper portion 14 of the frame 12. The column, and more specifically the outer low pressure gas tube 22, serves to convey the gas to a dispensing nozzle 34 below the diffuser plate 18, and also serves as an attachment structure for a float 26. The float 26 may comprise a tube having a toroidal shape, as shown, or any other practicable shape. The attachment of the float 26 to the medial portion of the column places the float 26 inside the frame 12.

The low and high pressure tubes or pipes 22 and 24 have lower ends 30, 28, respectively, that extend below the diffuser plate 18. The lower end 28 of the high-pressure tube 24 serves as an attachment point for a container 32 of pressurized gas. The gas may be air, oxygen, or other aeration gas, depending upon the aeration results desired. The term "aeration" as used herein means the dispensing of gas of any chemical element, compound, or mixture from the pressurized gas container 32 and through the diffuser plate 18 into the surrounding water. The lower end 28 of the high-pressure tube 24 may be equipped with a quick disconnect coupling, and the pressurized gas container 32 may be equipped with a complementary fitting. Other mating connector configurations may be used. The lower end 30 of the low-pressure gas supply tube 22 has a gas dispensing nozzle or fitting 34 thereon. The respective lengths of the two tubes 22 and 24 place the nozzle 34 between the pressurized gas container 32 and the overlying diffuser plate 18. The gas dispensing nozzle 34 is annular and installed at the end 30 of the low pressure tube 22 concentrically about the lower portion of the high pressure gas supply tube 24, and the pressurized gas container 32 is below the nozzle 34, being attached to the lower end 28 of the high pressure gas tube 24.

Relatively high pressure gas flows from the container 32 upward through the inner high pressure gas supply tube or line 24 to the upper end 36 thereof, which is located above the upper portion 14 of the frame 12. A pressure regulator valve 38 is provided at the upper end 36 of the high-pressure tube 24 or line 24. The regulator valve 38 communicates pneumatically with the pressurized gas container 32 by means of the high-pressure gas tube 24. A pressure gauge 40 may be provided with the valve 38 in order to determine the pressure within the high-pressure tube 24 from the container 32. The valve 38 reduces the gas pressure as it flows past the valve into the upper end 42 of the outer low pressure gas supply tube or line 22, and thence downward through the outer low pressure tube 22 to the dispensing nozzle 34.

While the above-described configuration could be simplified to use only a single support column by placing the pressure regulator valve 38 directly between the pressurized gas container 32 and the dispensing nozzle 34, such a configuration would make it considerably more difficult to adjust the output pressure of the gas. The use of a high-pressure tubes 24 extending above the top of the frame 12 places the control valve 38 above the water level for ease of access. A second low pressure gauge (not shown) similar to the gauge 40 illustrated, or in combination therewith, may be provided to measure the output pressure as adjusted by the regulator valve 38, if desired, or the output may be adjusted by observing the aeration gas as it bubbles to the surface from the diffuser plate 18.

The water aerator 10 is configured for substantially autonomous operation once the regulator valve 38 has been adjusted. Accordingly, it is important to provide means for indicating the status and condition of the device to a distant observer without the need to actually visit or travel to the device periodically. One potential problem with any buoyant object is the possibility of damage to the float for some reason or another. Accordingly, the aerator 10 may include buoyancy level indicators 44 disposed upon the arms of the frame 12. These indicators 44 may be provided in the form of sleeves over the arms, or may be painted, taped, or otherwise marked on the arms. The indicators 44 may comprise different colors to indicate the relative buoyancy of the device, or they may comprise other markings, numbers, etc. They may also provide another means of determining the gas content of the pressurized gas container 32, at least in relatively calm water and where the container 32 comprises a significant percentage of the total weight of the device. As the gas is depleted from the container 32, the weight of the container (and thus the weight of the entire device 10) will be reduced, which results in greater buoyancy for the device. While this is likely to be a minor effect, it may be noticeable under certain circumstances, so that the buoyancy level indicators 44 provide an indication of the weight reduction due to depletion of the gas in the container 32.

Additional warning of low gas pressure in the pressurized container 32 may be provided by a light 46 atop the central column. As the system described to this point is not electrically operated, an electrical storage battery 48 may be provided to power the light 46. The light 46 may be actuated by a pressure switch 50 that senses pressure from the high pressure side of the regulator 38 and closes the circuit between the battery 48 and light 46 when the pressure drops to some predetermined level. Alternatively, notification of low pressure in the container 32 or some other abnormal condition may be detected by conventional transducers and transmitted via conventional wireless telemetry, if desired.

Other electrical devices may be added to the aerator 10 if electrical power is provided. For example, an electrically powered propeller 52 and rudder 54 may be installed. The aerator 10 may include a conventional GPS receiver and position sensing device, as are commonly provided in relatively inexpensive personal electronic devices. Automated programming may be interfaced with such a system or device in order to remotely operate the propeller 52 and rudder 54 for station keeping at a given site, or to maneuver the aerator 10 from one position to another at predetermined times or as directed by remote control. A larger electrical storage battery, or more batteries, may be provided if a motorized propeller and rudder are added that accordingly require greater electrical power.

It is to be understood that the present invention is not limited to the embodiments described above, but encompasses any and all embodiments within the scope of the following claims.

I claim:

1. A water aerator, comprising:

an aerator frame, wherein the aerator frame has an upper portion and a lower portion opposite the upper portion;

a pressurized gas container disposed beneath the frame;

a gas-dispensing nozzle disposed beneath the flame, the nozzle communicating pneumatically with the pressurized gas container;

a float disposed generally medially within the frame; and an inner gas supply tube and an outer gas supply tube coaxially disposed around the inner gas supply tube, the gas supply tubes extending through the upper and lower portions of the frame, the inner gas supply tube having a lower end connected to the pressurized gas container and defining a high pressure gas supply, the outer gas supply tube having a lower end and defining a low pressure gas supply tube, the nozzle being attached to the lower end of the outer gas supply tube and disposed concentrically around the inner gas supply tube between the lower portion of the frame and the pressurized gas container, the inner and outer gas supply tubes defining a conduit for the flow of pressurized gas from the gas container up through the inner gas supply tube to above the upper portion of the frame and down through the outer gas supply tube and out through the nozzle below the lower portion of the frame.

2. The water aerator according to claim 1, further comprising:

a perforated diffuser plate disposed across the lower portion of the frame, the pressurized gas container and the gas-dispensing nozzle being disposed below the diffuser plate.

3. The water aerator according to claim 1, further comprising:

a pressure regulator valve disposed in the upper end of the inner gas supply tube, the pressure regulator valve communicating pneumatically with the inner gas supply tube; and a pressure gauge extending from the upper end of the inner gas supply tube, the pressure gauge communicating pneumatically with the inner gas supply tube.

4. The water aerator according to claim 1, wherein the float is toroidal; and a plurality of buoyancy level indicators disposed upon the flame.

5. The water aerator according to claim 1, further comprising:

a low pressure warning light disposed above the frame; and an electrical power source selectively connected to the low-pressure warning light.

6. A water aerator, comprising:

an aerator flame having an upper portion and a lower portion opposite the upper portion;

a float disposed generally medially within the frame;

at least one gas supply tube disposed concentrically within the float, the at least one gas supply tube having an upper end extending above the upper portion of the frame and a lower end extending below the lower portion of the frame, wherein the at least one gas supply tube comprises;

i) a high-pressure gas supply tube extending from the pressurized gas container to the pressure regulator valve; and ii) a low-pressure gas supply tube concentrically surrounding the high-pressure gas supply tube, the low-pressure gas supply tube extending from the pressure regulator valve and having a lower end;

a source of aeration gas connected to the lower end of the at least one gas supply tube, wherein the source of aeration gas is a pressurized gas container;

a pressure regulator valve disposed in the upper end of the high pressure gas supply tube, the pressure regulator valve communicating pneumatically with the high pressure gas supply tube;

a pressure gauge extending from the upper end of the high pressure gas supply tube, the pressure gauge communicating pneumatically with the high pressure gas supply tube; and a gas-dispensing nozzle disposed above the pressurized gas container, the gas-dispensing nozzle being attached to the lower end of the low-pressure gas supply tube, the gas-dispensing nozzle being disposed concentrically about the high-pressure gas supply tube.

7. The water aerator according to claim 6, wherein the water aerator further comprises:

a perforated diffuser plate disposed across the lower portion of the frame.

8. The water aerator according to claim 6, wherein the float is toroidal, the water aerator further comprising a plurality of buoyancy level indicators disposed upon the frame.

9. The water aerator according to claim 6, further comprising:

a low pressure warning light disposed above the frame; and an electrical power source selectively connected to the low-pressure warning light.

10. A water aerator, comprising:

an aerator frame having an upper portion and a lower portion opposite the upper portion;

a toroidal float disposed generally medially within the frame;

a perforated diffuser plate disposed across the lower portion of the frame;

a pressurized gas container disposed below the diffuser plate;

a gas dispensing nozzle; and an inner gas supply tube and an outer gas supply tube coaxially disposed around the inner gas supply tube, the gas supply tubes extending through the upper and lower portions of the frame, the inner gas supply tube having a lower end connected to the pressurized gas container, the outer gas supply tube having a lower end, the nozzle being attached to the lower end of the outer gas supply tube and disposed concentrically around the inner gas supply tube between the lower portion of the frame and the pressurized gas container, the inner and outer gas supply tubes defining a conduit for the flow of pressurized gas from the gas container up through the inner gas supply tube to above the upper portion of the frame and down through the outer gas supply tube and out through the nozzle below the lower portion of the frame.

11. The water aerator according to claim 10, further comprising:

a pressure regulator valve disposed above the upper portion of the frame between the inner gas supply tube and the outer gas supply tube; and a pressure gauge disposed in the inner gas supply tube above the upper portion of the frame adjacent the pressure regulator valve.

12. The water aerator according to claim 10, further comprising:

a plurality of buoyancy level indicators disposed upon the frame;

a low pressure warning light disposed above the frame; and an electrical power source selectively connected to the low pressure warning light.

* * * * *